US005783364A

United States Patent [19]

Ellis et al.

[11] Patent Number: 5,783,364

[45] Date of Patent: Jul. 21, 1998

[54] THIN-FILM IMAGING RECORDING CONSTRUCTIONS INCORPORATING METALLIC INORGANIC LAYERS AND OPTICAL INTERFERENCE STRUCTURES

[75] Inventors: Ernest W. Ellis, Harvard, Mass.; Thomas E. Lewis, E. Hampstead, N.H.

[73] Assignee: Presstek, Inc., Hudson, N.H.

[21] Appl. No.: 700,287

[22] Filed: Aug. 20, 1996

[51] Int. Cl.[6] ..... B41N 1/08

[52] U.S. Cl. ..... 430/302; 430/300; 430/945; 101/467; 101/454

[58] Field of Search ..... 101/467, 471, 101/470, 457, 454; 430/945, 300, 302

[56] References Cited

U.S. PATENT DOCUMENTS

| | | | |
|---|---|---|---|
| 2,590,906 | 4/1952 | Tripp | 359/584 |
| 3,665,483 | 5/1972 | Becker et al. | 347/262 |
| 3,964,389 | 6/1976 | Peterson | 101/467 |
| 4,020,762 | 5/1977 | Peterson | 101/467 |
| 4,054,094 | 10/1977 | Caddell et al. | 101/467 |
| 4,214,249 | 7/1980 | Kasai et al. | 346/761 |
| 4,305,081 | 12/1981 | Spong | 430/945 |
| 4,335,198 | 6/1982 | Hanada et al. | 430/945 |
| 4,638,335 | 1/1987 | Smith et al. | 430/945 |
| 5,009,486 | 4/1991 | Dobowolski et al. | 350/164 |
| 5,109,771 | 5/1992 | Lewis et al. | 101/453 |
| 5,165,345 | 11/1992 | Lewis et al. | 101/453 |
| 5,249,525 | 10/1993 | Lewis et al. | 101/453 |
| 5,256,506 | 10/1993 | Ellis et al. | 430/20 |
| 5,339,737 | 8/1994 | Lewis et al. | 101/454 |
| 5,354,633 | 10/1994 | Lewis et al. | 430/5 |
| 5,379,698 | 1/1995 | Nowak et al. | 101/457 |
| 5,478,695 | 12/1995 | Leenders | 430/259 |

FOREIGN PATENT DOCUMENTS

| | | |
|---|---|---|
| 0 160 396 | 3/1985 | European Pat. Off. . |
| 2-235789 | 4/1990 | Japan . |
| 2036597 | 7/1980 | United Kingdom . |

OTHER PUBLICATIONS

Jenkins and White, "Fundamentals of Optics" copyright 1979, pp. 286–297.

*Primary Examiner*—Martin Angebranndt
*Attorney, Agent, or Firm*—Cesari and McKenna, LLP

[57] ABSTRACT

Constructions useful as lithographic printing plates include metallic inorganic layers exhibiting both hydrophilicity and substantial durability at very thin application levels. These materials ablatively absorb imaging radiation, thereby facilitating direct imaging without chemical development. They can also be used to form optical interference structures which, in addition to providing color, likewise absorb imaging radiation and ablate in response to imaging pulses.

61 Claims, 7 Drawing Sheets

THIN-FILM IMAGING RECORDING CONSTRUCTIONS INCORPORATING METALLIC INORGANIC LAYERS AND OPTICAL INTERFERENCE STRUCTURES

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

U.S. Pat. Nos. 5,339,737 and 5,379,698, the entire disclosures of which are hereby incorporated by reference, disclose a variety of lithographic plate configurations for use with imaging apparatus that operate by laser discharge (see, e.g., U.S. Pat. No. 5,385,092 and U.S. Application Ser. No. 08/376,766). These include "wet" plates that utilize fountain solution during printing, and "dry" plates to which ink is applied directly.

In particular, the '698 patent discloses laser-imageable plates that utilize thin-metal ablation layers which, when exposed to an imaging pulse, are vaporized and/or melted even at relatively low power levels. The remaining unimaged layers are solid and durable, typically of polymeric or thicker metal composition, enabling the plates to withstand the rigors of commercial printing and exhibit adequate useful lifespans.

In one general embodiment, the plate construction includes a first, topmost layer chosen for its affinity for (or repulsion of) ink or an ink-abhesive fluid. Underlying the first layer is a thin metal layer, which ablates in response to imaging (e.g., infrared, or "IR" ) radiation. A strong, durable substrate underlies the metal layer, and is characterized by an affinity for (or repulsion of) ink or an ink-abhesive fluid opposite to that of the first layer. Ablation of the absorbing second layer by an imaging pulse weakens the topmost layer as well. By disrupting its anchorage to an underlying layer, the topmost layer is rendered easily removable in a post-imaging cleaning step. This, once again, creates an image spot having an affinity for ink or an ink-abhesive fluid differing from that of the unexposed first layer.

A considerable advantage to these types of plates is avoidance of environmental contamination, since the products of ablation are confined within a sandwich structure; laser pulses destroy neither the topmost layer nor the substrate, so debris from the ablated imaging layer is retained therebetween. This is in contrast to various prior-art approaches, where the surface layer is fully burned off by laser etching; see, e.g., U.S. Pat. Nos. 4,054,094 and 4,214,249. In addition to avoiding airborne byproducts, plates based on sandwiched ablation layers can also be imaged at low power, since the ablation layer does not serve as a printing surface and therefore need not be especially durable; a durable layer is generally thick and/or refractory, ablating only in response to significant energy input. The price of these advantages, however, is the above-noted post-imaging cleaning step.

In addition, the polymeric topmost coatings ordinarily required for the sandwiched-ablation-layer approach may exhibit less durability than traditional printing plates. For example, conventional, photoexposure-type wet plates may utilize a heavy aluminum surface capable of surviving hundreds of thousands of impressions. Sandwiched-ablation-layer plates, by contrast, utilize polymeric topcoats that pass laser radiation through to the ablation layer. Hydrophilic polymers, such as polyvinyl alcohols, do not exhibit the durability of metals.

Difficulties can also be encountered when the sandwiched ablation layer is metal. First, a careful balance must be struck between reflection, absorption and transmission of imaging radiation. Metals exhibit an inherent tendency to reflect radiation; at the miniscule deposition thicknesses required for low-power imaging, however, a metal layer will absorb some radiation (which provides the ablation mechanism) and also pass some through. Increasing the thickness of such a layer augments laser power requirements not only through the addition of material, but also due to increased reflection of imaging radiation. The overall result is a maximum thickness limit, which restricts the ability to increase plate durability through thicker metal imaging layers.

Furthermore, thin imaging layers based on metal/non-metal combinations (e.g., metal oxides) can exhibit rigidity when deposited on a flexible polymeric substrate. Rigidity, too, increases with layer thickness, and excessively thick metal/non-metal layers will be vulnerable to fracture; for example, dimensional stress leading to fracture can occur as a result of heating and cooling, as when a thermoset coating is applied over such a layer and cured. A printing plate with an imaging layer damaged in this way will exhibit poor durability and possibly a loss of image quality.

Another type of problem that may arise in connection with sandwiched-ablation-layer plates concerns the ability to visually distinguish imaged from unimaged areas. Where the substrate is clear, the silvery metallic appearance of regions that have not received laser exposure may not contrast with the surface (e.g., a plate cylinder or inspection table) underlying the printing member, so that the imaged areas cannot be readily discerned. Similar difficulty may occur, for example, in certain constructions outlined in the '737 patent and allowed application Ser. No. 08/433,994, filed on May 4, 1995 and entitled LASER-IMAGEABLE LITHOGRAPHIC PRINTING MEMBERS WITH DIMENSIONALLY STABLE BASE SUPPORTS (the entire disclosure of which is hereby incorporated by reference) regardless of what underlies the construction. In particular, it is possible to laminate the above-described construction to a metal support that not only provides dimensional stability, but also acts to reflect transmitted imaging radiation back into the thin metal layer. Assuming clear substrate and laminating adhesive materials, however, the metal support, which remains intact after imaging, is likely to offer little contrast to the thin-metal layer.

Also as described in the '994 application, it is possible to utilize thin-metal imaging layers over metal base supports without lamination. Although thermally conductive metal supports would dissipate imaging energy if disposed directly beneath the thin metal layer, the '994 application details constructions that concentrate heat in the thin metal layer, preventing (or at least retarding) its transmission and loss into the base support. To accomplish this, a thermally insulating layer is interposed between the imaging layer and the thermally conductive base support. Once again, assuming that the insulating layer is fabricated from a clear polymeric material, contrast between the thin metal layer and the metal base support will be minimal.

Printers have traditionally exploited contrast between imaged and unimaged plate regions to facilitate visual inspection. Typically, the press operator first utilizes the gross patterns to ensure that the plate corresponds to the current job, and that the series of plates on successive plate cylinders correspond to one another. He can then inspect the contrasting regions of the plates more closely, verifying proper overall imaging and the presence of key details prior to operating the press. The absence or a low level of contrast makes it difficult or impossible for a press operator to perform these identification and inspection activities by examination of the plate. Although the press operator can prepare a proof to obtain direct visualization of the plate image, this is time-consuming operation, particularly in a computer-to-plate environment.

Accordingly, a need exists for constructions that impart contrast between visually adjacent plate layers of similar tonality. One solution to this problem is set forth in U.S. Application Ser. No. 08/508,330, filed on Jul. 27, 1995 and co-owned with the present application. The disclosed constructions contain a colorant that observably distinguishes the ink-accepting layer(s) from the ink-repelling layer(s), but which does not substantially interfere with the action of the imaging pulses. In one embodiment, the printing member comprises a topmost layer, a thin metal imaging layer and a polymeric substrate comprising a material (such as a dispersed pigment, e.g., barium sulfate) that reflects imaging radiation and is tonally dissimilar to the thin metal layer. The colorant is chemically integrated, dispersed or dissolved within the polymer matrix of the substrate. Alternatively, because the topmost layer is removed as a consequence of the imaging process, it is possible to locate the colorant in this layer instead of (or in addition to) the substrate.

In a second embodiment, a construction comprising a topmost layer, a thin metal imaging layer and a polymeric substrate is laminated to a metal base support that is tonally similar to the imaging layer. A first version of this embodiment locates the colorant in the substrate layer, so that if the base support reflects unabsorbed imaging radiation, this will pass back to the thin metal layer through the colorant-containing substrate without significant absorption. In a second version, the colorant is located in the laminating adhesive. This second approach is advantageous in that it permits observation, for quality-control purposes, of the uniformity of the adhesive layer. Indeed, even in applications where visible contrast between imaged and unimaged plate regions is unnecessary (or perhaps even undesirable), a dye that is invisible under ambient light but observable under special conditions (e.g., which fluoresces under ultraviolet light) can be located within the adhesive layer. In a third version of this embodiment, the colorant is located in the topmost layer as discussed above. The colorant may be a dye, a pigment or a combination thereof.

Contrast can be useful for purposes other than visual proofing. For example, different colors can be used to distinguish different types of recording media, or for decoration, or for authentication. For these purposes, it may be desirable to utilize contrast media having color characteristics more complex than those of a simple dye or pigment.

DESCRIPTION OF THE INVENTION

Brief Summary of the Invention

In a first aspect, the present invention utilizes certain metallic inorganic materials as surface layers in lithographic printing plates. These materials are both hydrophilic and very durable, making them desirable for wet-plate constructions. Indeed, the metallic inorganic materials of the present invention exhibit satisfactory durability even at very small deposition thicknesses. As a result, the amount of debris produced by the imaging process is minimal, and that debris tends to be nonvolatile. The metallic inorganic layers may be conveniently applied by vacuum coating techniques. These layers are readily removable by, for example, laser imaging radiation, and their hydrophilic character may be preserved through application of a thin, water-responsive overcoat. Alternatively, a metallic inorganic material can serve as an integral layer beneath a separate hydrophilic or oleophobic layer.

In a variation of this aspect of the invention, the metallic inorganic layer can serve as part of an optical interference structure to afford a wider range of visual characteristics. For example, such structures provide contrast between layers, as well as color variations that cannot be easily duplicated by other means.

More generally, optical interference structures include constructions that pass light, selectively reinforcing and/or canceling certain wavelengths (e.g., to eliminate reflection that occurs when light passes between media having different refractive indices), and constructions that reflect incident light in a manner that emphasizes a particular wavelength (usually a visible color). In the latter case, the color varies with viewing angle in a characteristic fashion.

Reflective optical interference structures typically include a reflective metal layer, a transparent dielectric material thereover, and a semi-reflective metal layer above the dielectric layer. When incident light strikes the semi-reflective metal layer of the optical interference structure, some of the light is reflected but some passes through both this layer and the underlying dielectric. The transmitted portion of the beam is then reflected by the bottommost metal layer and retransmitted through the dielectric; some of this reflected light passes through the semi-reflective top layer where it may constructively or destructively interfere with light initially reflected by the top layer. The thickness of the dielectric layer is chosen such that, when light reflected from the top and bottom metal layers combines, a chosen wavelength will undergo constructive interference while other wavelengths will undergo some degree of destructive interference. Specifically, the thickness of the dielectric layer is a small, even multiple of one-fourth the desired wavelength (a "quarter wavelength"), allowing for the wavelength shift caused by the refractive index of the dielectric material. Thus, when a reflective interference filter is observed in white light, it reflects a strong characteristic color. (As used herein, the term "quarter wave" is used to connote a material thickness equal to an even multiple of a quarter wavelength.)

One optical property of such interference structures, which has proven useful as an anti-counterfeiting measure, is that the color reflected from the structure depends on the path length of light passing through the dielectric material. As a result, the observed color changes with the angle of incident light. When such a structure is observed under light incident normal to the filter, a certain color (e.g., blue) is seen. When the angle of incidence and reflection is more acute, however, the total path length through the dielectric material is longer. As a result, when the interference structure is observed at an angle nearer grazing incidence, a longer wavelength color (e.g., purple) is observed. This complex dependence of color on incidence angle cannot be reproduced without reproducing the interference filter itself.

In accordance with another aspect of the present invention, optical interference structures not necessarily including inorganic metallic layers are used to provide contrast between recording layers having similar tonalities. The approach contemplated herein may be applied to any of a variety of recording constructions imageable by radiation of varying peak wavelengths. In particular, the invention is suited to lithographic printing plates imageable with solid-state diode lasers as described in the '092 patent at pulse times in excess of 1 μsec, typically from 5–13 μsec, and longer if desired. The invention is also suited to lithgraphic printing plates imageable with high-intensity lasers at pulse times of a few nanoseconds or less. As used herein, the term "plate" refers to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement. The term "photomask" refers to a negative transparency placed between a photosensitive recording medium (typically a photoexposure-type printing plate) and a source of actinic radiation. During exposure, the photomask prevents illumination from reaching non-image portions of the recording medium. The term "proofing sheet" or "proof" refers to a medium that provides a preview of an imaged printing plate by rendering the plate image so as to contrast with a non-image background.

All constructions of the present invention utilize layers that ablatively absorb laser radiation. Generally, preferred imaging wavelengths lie in the IR, and preferably near-IR region; as used herein, "near-IR" means imaging radiation whose $lambda_{max}$ lies between 700 and 1500 nm. An important feature of the present invention is its usefulness in conjunction with solid-state lasers (commonly termed semiconductor diode lasers, these include devices based on gallium aluminum arsenide compounds and single-crystal lasers (e.g., Nd:YAG and Nd:YLF) that are themselves diode-laser- or lamp-pumped) as sources of imaging radiation; these are distinctly economical and convenient, and may be used in conjunction with a variety of imaging devices. The use of near-IR radiation facilitates use of a wide range of organic and inorganic absorption materials.

The constructions may also be provided with dimensionally stable base supports (generally applied by lamination), reflective layers that concentrate imaging radiation within the ablation layer(s), and layers promoting structural hardness.

BRIEF DESCRIPTION OF THE DRAWINGS

The foregoing discussion will be understood more readily from the following detailed description of the invention, when taken in conjunction with the accompanying drawings, in which.

The drawings and components shown therein are not necessarily to scale.

DETAILED DESCRIPTION OF THE PREFERRED EMBODIMENTS

Figure 1:
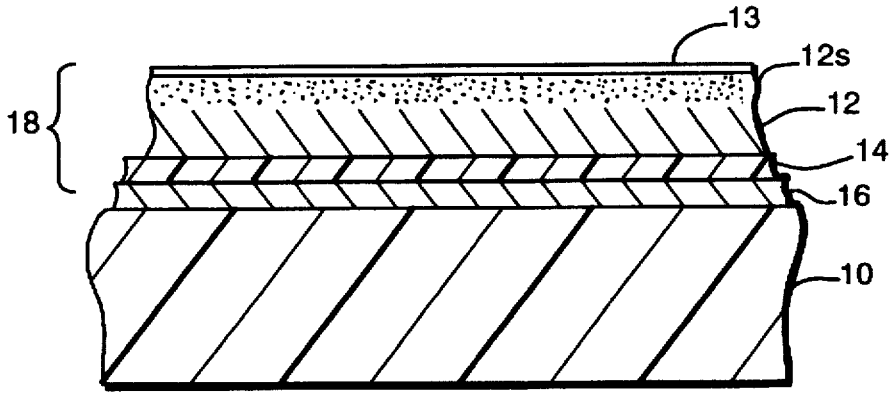
FIG. 1 is an enlarged sectional view of a general recording construction having at least a substrate and, disposed thereon, a laser-ablatable metal having an oxide surface, and optionally an optical interference structure.

Refer first to FIG. 1, which illustrates a first embodiment of the present invention. The depicted construction includes, in its most basic form, a substrate 10 and a surface layer 12. Substrate 10 is preferably strong, stable and flexible, and may be a polymer film, or a paper or metal sheet. Polyester films (in a preferred embodiment, the MYLAR film sold by E.I. duPont de Nemours Co., Wilmington, Del., or, alternatively, the MELINEX film sold by ICI Films, Wilmington, Del.) furnish useful examples. A preferred polyester-film thickness is 0.007 inch, but thinner and thicker versions can be used effectively.

Paper substrates are typically "saturated" with polymerics to impart water resistance, dimensional stability and strength. Aluminum is a preferred metal substrate. Ideally, the aluminum is polished so as to reflect any imaging radiation penetrating any overlying optical interference layers. One can also employ, as an alternative to a metal reflective substrate 10, a layer containing a pigment that reflects imaging (e.g., IR) radiation. A material suitable for use as an IR-reflective substrate is the white 329 film supplied by ICI Films, Wilmington, Del., which utilizes IR-reflective barium sulfate as the white pigment. A preferred thickness is 0.007 inch, or 0.002 inch if the construction is laminated onto a metal support as described hereinbelow.

Layer 12 is a very thin (50–500 Å, with 300 Å preferred for titanium) layer of a metal that may or may not develop a native oxide surface 12*s* upon exposure to air. This layer ablates in response to IR radiation. The metal or the oxide surface thereof exhibits hydrophilic properties that provide the basis for use of this construction as a lithographic printing plate. Imagewise removal, by ablation, of layers 12 and 12*s* exposes underlying layer 10, which is both hydrophobic and oleophilic; accordingly, while layers 12/12*s* accept fountain solution, layer 10 rejects fountain solution but accepts ink. Complete ablation of layer 12 is therefore important in order to avoid residual hydrophilic metal in an image feature.

The metal of layer 12 is at least one d-block (transition) metal, aluminum, indium or tin. In the case of a mixture, the metals are present as an alloy or an intermetallic. Again, the development, on more active metals, of an oxide layer can create surface morphologies that improve hydrophilicity. Such oxidation can occur on both metal surfaces, and may also, therefore, affect adhesion of layer 12 to substrate 10 (or other underlying layer). Substrate 10 can also be treated in various ways to improve adhesion to layer 12. For example, plasma treatment of a film surface with a working gas that includes oxygen (e.g., an argon/oxygen mix) results in the addition of oxygen to the film surface, improving adhesion by rendering that surface reactive with the metal(s) of layer 12. Oxygen is not, however, necessary to successful plasma treatment. Other suitable working gases include pure argon, pure nitrogen, and argon/nitrogen mixtures. See, e.g., Bernier et al., *ACS Symposium Series* 440, *Metallization of Polymers*, p. 147 (1990).

The hydrophilicity, durability, shelf life and scratch resistance of layers 12/12s can be improved through treatment with gum arabic or the gumming agents found in commercial plate finishers and fountain solutions; in particular, the TRUE BLUE plate cleaning material and the VARN TOTAL fountain solution supplied by Varn Products Company, Oakland, N.J. are suitable for this purpose, as are the FPC product from the Printing Products Division of Hoescht Celanese, Somerville, N.J., the G-7A-"V"-COMB fountain solution supplied by Rosos Chemical Co., Lake Bluff, Ill., the VANISH plate cleaner and scratch remover marketed by Allied Photo Offset Supply Corp., Hollywood, Fla., and the POLY-PLATE plate-cleaning solution also sold by Allied. Other preferred materials contain, as a primary ingredient, polyethylene glycol with an average molecular weight of about 8000. Still another useful finishing material is polyvinyl alcohol, applied as a very thin layer. The result of finishing treatment is shown as a finish layer 13.

If layer 12 is partially reflective, two additional layers 14, 16 can be added to this construction and which, when combined with layer 12, form an optical interference structure 18. Ignition of layer 12 burns away intermediate layers 14, 16. Layer 14 is a quarter-wave dielectric spacer whose thickness depends, as set forth above, on the wavelength of interest. A thickness between 0.05 and 0.9 μm produces a visible contrast color. This layer is ordinarily polymeric, and is preferably a polyacrylate. Suitable polyacrylates include polyfunctional acrylates or mixtures of monofunctional and polyfunctional acrylate that may be applied by vapor deposition of monomers followed by electron-beam or ultraviolet (UV) cure.

Layer 16 is a reflective layer, e.g., aluminum of thickness ranging from 50 to 500 Å (or thicker, if feasible given laser power output and the need for complete ablation). Layers 12, 14 and 16 can all be deposited under vacuum conditions. In particular, layers 12 and 16 may be deposited by vacuum evaporation or sputtering (e.g., with argon); in the case of layer 16, it is preferred to vacuum sputter onto a plasma-treated polyester substrate 10. Layer 14 can be applied by vapor deposition; for example, as set forth in U.S. Pat. Nos. 4,842,893 and 5,032,461 (the entire disclosures of which are hereby incorporated by reference), low-molecular-weight monomers or prepolymers can be flash vaporized in a vacuum chamber, which also contains a web of material (e.g., a suitably metallized substrate 10) to be coated. The vapor is directed at the surface of the moving web, which is maintained at a sufficiently low temperature that the monomer condenses on its surface, where it is then polymerized by exposure to actinic radiation. Ordinarily, the monomers or prepolymers have molecular weights in the range of 150–800.

Figure 2:
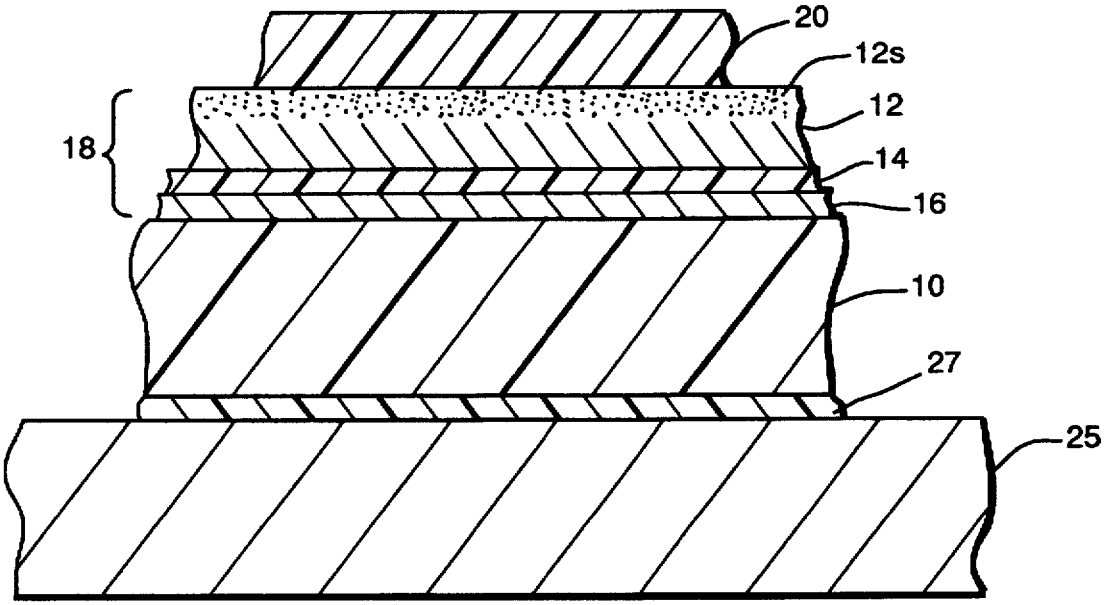
FIG. 2 is an enlarged sectional view of a lithographic plate embodying the invention and having an optical interference structure comprising a partially reflective, thin first metal layer, e.g., titanium; a polymeric quarter-wave spacer; and a reflective second metal layer.

FIG. 2 illustrates a variation of this embodiment, in which layers 12/12s are covered by a surface layer 20. In this case, layers 10 and 20 exhibit opposite affinities for ink or an ink-adhesive fluid; this approach affords the use of surface layers having affinity and/or durability characteristics different from that of layers 12/12s. In one version of this plate, surface layer 20 is a silicone polymer or fluoropolymer that repels ink, while substrate 10 is an oleophilic polyester or aluminum material; the result is a dry plate. In a second, wet-plate version, surface layer 20 is a hydrophilic material such as a polyvinyl alcohol (e.g., the Airvol 125 material supplied by Air Products, Allentown, Pa.), while substrate 10 is both oleophilic and hydrophobic (again, polyester is suitable).

For dry-plate constructions that utilize a silicone layer 20, titanium is the preferred metal for layer 12. Particularly where the silicone is cross-linked by addition cure, an underlying titanium layer offers substantial advantages over other metals. Coating an addition-cured silicone over a titanium layer results in enhancement of catalytic action during cure, promoting substantially complete cross-linking; and may also promote further bonding reactions even after cross-linking is complete. These phenomena strengthen the silicone and its bond to the titanium layer, thereby enhancing plate life (since more fully cured silicones exhibit superior durability), and also provide resistance against the migration of ink-borne solvents through the silicone layer (where they can degrade underlying layers). Catalytic enhancement is especially useful where the desire for high-speed coating (or the need to run at reduced temperatures to avoid thermal damage to the ink-accepting support) make full cure on the coating apparatus impracticable; the presence of titanium will promote continued cross-linking despite temperature reduction.

Useful materials for layer 20 and techniques of coating are disclosed in the '737 and '032 patents as well as in U.S. Pat. Nos. 5,353,705 and 5,379,698. Basically, suitable silicone materials are applied using a wire-wound rod, then dried and heat-cured to produce a uniform coating deposited at, for example, 2 g/m$^2$. In the case of polyvinyl alcohols, suitable materials are typically produced by hydrolysis of polyvinyl acetate polymers. The degree of hydrolysis affects a number of physical properties, including water resistance and durability. Thus, to assure adequate plate durability, the polyvinyl alcohols used in the present invention reflect a high degree of hydrolysis as well as high molecular weight. Effective hydrophilic coatings are sufficiently crosslinked to prevent redissolution as a result of exposure to fountain solution, but also contain fillers to produce surface textures that promote wetting. Selection of an optimal mix of characteristics for a particular application is well within the skill of practitioners in the art. Useful polyvinyl-alcohol surface coatings may be applied, for example, using a wire-wound rod, followed by drying for 1 min at 300° F. in a convection oven to application weight of 1 g/m$^2$.

Exposure of the foregoing construction to laser output weakens or removes layer 20 and ablates optical interference structure 18 in the region of exposure. The weakened surface coating (and any debris remaining from destruction of the absorbing second layer) is removed in a post-imaging cleaning step. In particular, such cleaning can be accomplished using a contact cleaning device such as a rotating brush (or other suitable means as described, for example, in U.S. Pat. No. 5,148,746), without fluid or with a non-solvent for the topmost layer. Although post-imaging cleaning represents an additional processing step, the persistence of the topmost layer during imaging can actually prove beneficial. Ablation of the absorbing layers creates debris that can interfere with transmission of the laser beam (e.g., by depositing on a focusing lens or as an aerosol (or mist) of fine particles that partially blocks transmission). The disrupted but unremoved topmost layer prevents escape of this debris.

Layer 25 is an optional metal support. In a representative production sequence, layers 16, 14 and then 12 are deposited under vacuum conditions onto a polyester film, which serves as substrate 10. Layer 20 is then coated onto layer 12, following which the coated material is laminated, using a laminating adhesive 27, onto an aluminum base 25 having a thickness appropriate to the overall plate thickness desired. In addition to conferring rigidity, lamination in accordance with the present invention can include reflection capability.

Support 25 preferably reflects unabsorbed imaging radiation that has passed through optical interference structure 18 and layers thereunder; in the case, for example, of near-IR imaging radiation, aluminum (and particularly polished aluminum) laminated supports provide highly advantageous reflectivity. In this instance, substrate 10, laminating adhesive 27 and any other layers between optical interference structure 18 and support 25 (e.g., a primer coat) should be largely transparent to imaging radiation. In addition, substrate 10 should be relatively thin so that beam energy density is not lost through divergence before it strikes the reflective support. For proper operation in conjunction with the laser equipment described hereinabove, polyester substrates, for example, are preferably no thicker than 0.002 inch.

Alternatively, a polyester support 25 can be metallized with a thin layer of a reflective metal before lamination. Such an arrangement exhibits substantial flexibility, and is therefore well-suited to plate-winding arrangements. Preferably, the reflective layer is a reflective metal (e.g., aluminum) having a thickness from 50 to 500 Å or more, and support 25 is a heavy (e.g., 0.007 inch) polyester layer.

In another alternative, the laminating adhesive contains a material (e.g., a pigment such as barium sulfate) that reflects imaging radiation.

Suitable techniques of lamination are well-characterized in the art, and are disclosed, for example, in the '032 patent and the '994 application. In production of printing members, it is preferred to utilize materials both for substrate 10 and for support 25 in roll (web) form. Accordingly, roll-nip laminating procedures are preferred. In this production sequence, one or both surfaces to be joined are coated with a laminating adhesive; the surfaces are then brought together under pressure and, if appropriate, heated in the nip between cylindrical laminating rollers. Other suitable techniques include electron-beam and UV cure approaches.

In another variation to this approach, substrate 10 is a reflective metal (e.g., aluminum) sufficiently thick (e.g., 0.005 inch or more) so as not to ablate in response to imaging radiation. In this case, layer 16 can be eliminated, since substrate 10 provides the reflecting function (and also serves as the ink acceptor in dry printing applications). In its simplest form, this variation comprises a surface layer 20, an underlying thin-metal layer 12 that is partially reflective (and which may or may not contain an oxide surface **12*s*), a quarter-wave spacer 14, and the reflective substrate 10. Ordinarily, because a metal substrate 10 may, following imaging, exhibit some residual hydrophilicity in addition to the desired oleophilicity, an ink-rejecting (e.g., silicone) layer 20** is used to form a dry plate.

Figure 3:
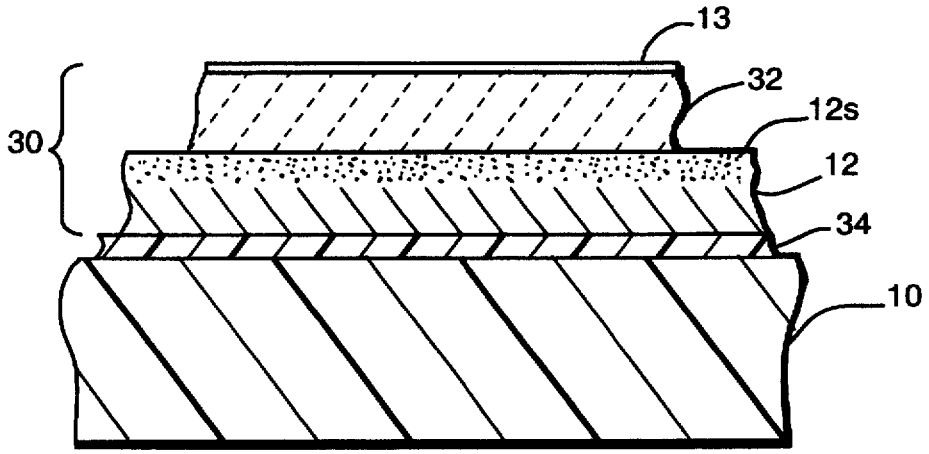
FIG. 3 is an enlarged sectional view of another general recording construction having a substrate and, disposed thereon, a laser-ablatable, inorganic metallic layer that may optionally form part of an optical interference structure.

Refer now to FIG. 3, which illustrates the second embodiment of the invention, in which a hard, durable, conductive, hydrophilic layer 32 is disposed directly above layer 10 or, more preferably, above a metal layer 12, since addition of the latter tends to improve overall adhesion. In the latter case, layer 12 may or may not contain an oxide interface **12*s*. A finishing treatment 13 may be applied to layer 32**.

Layer 32 is a metallic inorganic layer comprising a compound of at least one metal with at least one non-metal, or a mixture of such compounds. Along with underlying layer **12/12*s*, layer 32 ablatively absorbs imaging radiation, and consequently is applied at a thickness of only 100–2000 Å. Accordingly, the choice of material for layer 32** is critical, since it must serve as a printing surface in demanding commercial printing environments, yet ablate in response to imaging radiation. This approach is therefore distinct from the multilayer constructions disclosed in U.S. Pat. No. 5,354,633, which is directed toward blockage of actinic radiation rather than function as a printing plate. As a result, the constructions of the '633 patent require a thick series of layers that do not respond uniformly to imaging radiation. Instead, only the top layer or layers actually ablate in response to imaging radiation; this layer or layers, in turn, cause ignition of the underlying opaque layer, which is destroyed as a result of that ignition and not the action of the laser beam.

The metal component of layer 32 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 32 may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include TiN, TiON, $TiO_x$ (where $0.9>x>2.0$), TiAlN, TiAlCN, TiC and TiCN.

Certain species are not suited to use in layer 32. These include the chalcogenides, sulfur, selenium and tellurium; the metals antimony, thallium, lead and bismuth; and the elemental semiconductors silicon and germanium present in proportions exceeding 90% of the material used for layer 32; and compounds including arsenic (e.g., GaAs, GaAlAs, GaAlInAs, etc.). These elements fail in the context of the present invention due to lack of conductivity, poor durability, absence of hydrophilicity, chemical instability and/or environmental and toxicity concerns. The primary considerations governing the choice of material are performance as an optical interference construction (if desired), adhesion to adjacent layers, ablation response, the absence of toxic materials upon ablation, and the economics of procurement and application. Generally, layer 32 is applied as a vacuum-coated thin film.

Figure 4A:
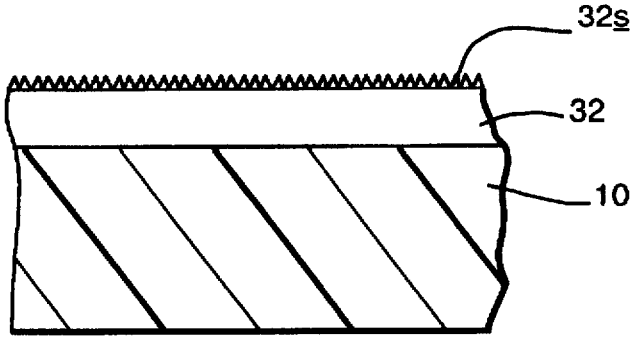
FIGS. 4A–4C depict the vulnerability to fracturing of certain prior-art plate constructions containing metal layers.
Figure 4B:
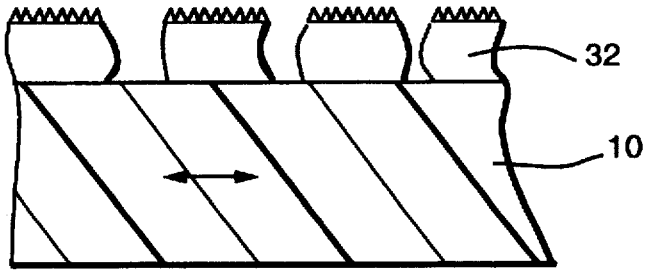
Figure 4C:
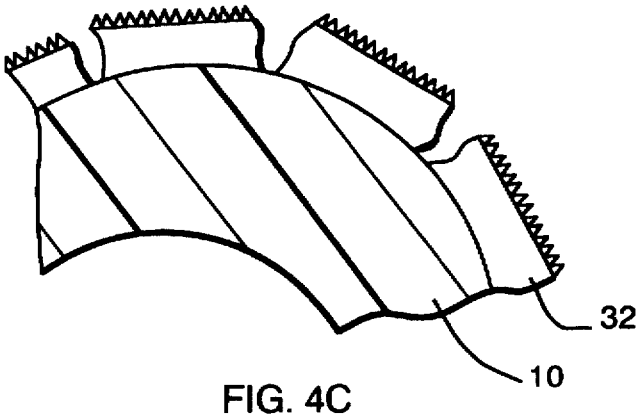

The thicknesses at which layer 32 is deposited facilitate creation of a texture that exhibits superior resistance to dimensional stress when compared with smooth layers, which tend to behave in the manner illustrated in FIGS. 4A through 4C. FIG. 4A shows a smoothly applied metallic inorganic layer 32 (e.g., having a thickness of 1000 to 5000 Å or more), which may contain a textured surface **32*s*. Dimensional stress on substrate 10, as indicated by the arrows in FIG. 4B, tends to fracture or craze layer 32 due to its inherent rigidity, which arises in part simply from application thickness. Dimensional stress giving rise to the illustrated fracturing may result, for example, from thermally induced differential expansions or contractions during the process of curing an overlying polymeric layer. FIG. 4C depicts a second circumstance that can give rise to fracturing, namely, bending of the structure. In addition to crazing, however, bending of a rigid layer 32 can also result in its delamination from underlying layer 10**, with attendant performance degradation and unreliable responsiveness to imaging radiation. Unfortunately, at least some degree of bending virtually always attends the printing process; for example, plates are usually wrapped around a plate cylinder in preparation for printing, and the plate may be affixed by further bending into a clamping mechanism. Indeed, bending frequently occurs during plate production, well before it is used: during manufacture of plate material as a "web" for subsequent division into individual plates, the plate material is typically wound into a roll.

Figure 5A:
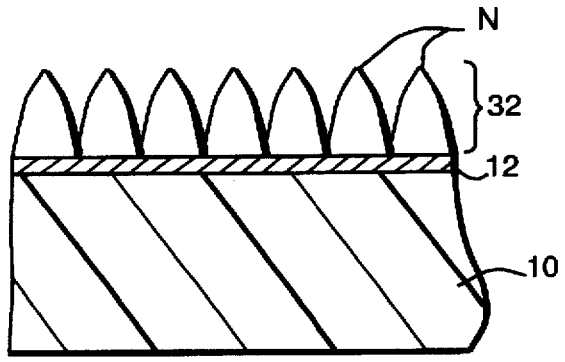
FIGS. 5A–5C depict the preferred microscopic structure of a inorganic metallic layer in accordance with the invention and its response to dimensional stress.
Figure 5B:
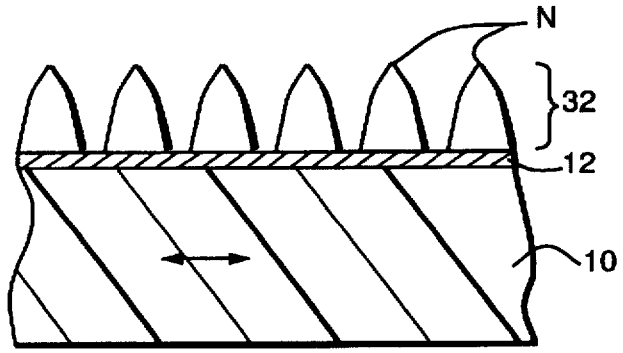
Figure 5C:
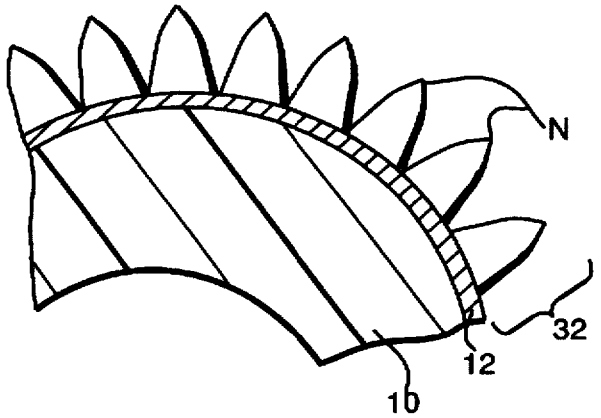

A solution to this problem is illustrated in FIGS. 5A–5C. The depicted constructions include a metal layer 12 which, as discussed previously, is applied at a thickness of 100–2000 Å. By contributing to the imaging process through absorption of radiation, layer 12 allows the characteristics of layer 32 to be adjusted so as to minimize rigidity, since layer 32 need not absorb the major portion of an imaging pulse. Nonetheless, because layer 32 is typically hydrophilic, its complete removal by ablation is important, since any remainders will interact with fountain solution and degrade the image; and layer 32 must be sufficiently thick to be durable. Layer 12 assists in these aspects as well by partially reflecting imaging radiation back into layer 32.

Resistance to fracturing and delamination is achieved primarily through application of layer 32 in a manner that gives rise to a surface morphology which may be characterized as nodular or dendritic. The metallic inorganic materials envisioned for layer 32 tend to deposit initially in microscopic clumps or clusters. At sufficient deposition densities, the clusters coalesce and the layer takes on the smooth, uniform morphology characteristic of the thick layers shown in FIGS. 4A–4C, with consequent rigidity problems. By retaining the structure shown in FIGS. 5A–5C, with a three-dimensional texture of dendrites or nodules N persisting throughout the surface of layer 32, vulnerability to stresses is decreased. This is due to the separability of the individual nodules N, so that, as shown in FIG. 5B, dimensional stress simply draws the individual nodules N apart rather than fracturing the surface; and as shown in FIG. 5C, the structure also tolerates bending, since nodules N are free to separate angularly as well without disruption of anchorage. Furthermore, because nodules N are microscopic and therefore present at high texture densities, neither type of deformation compromises the hydrophilic character of the surface. And because layer 12 is applied at very small thicknesses, that layer, too, is able to tolerate thermally and mechanically induced stresses without crazing, also acting as a "tie" or adhesion-promoting layer that anchors layer 32.

Because hard materials deposited on softer materials (e.g., polyesters) can be vulnerable to scratching and similar surface damage, it may be helpful to add an underlying layer 34 harder than substrate 10. Layer 34 can be a polyacrylate, which may be applied under vacuum conditions as described above, or a polyurethane. A representative thickness range for layer 34 is 1–2 μm. In the case of a metal substrate 10, layer 34 can comprise a thermally insulating material that prevents dissipation of the imaging pulse into substrate 10, and which serves as a printing surface (exhibiting an affinity for ink and/or fountain solution different from the topmost surface).

Depending on the optical characteristics of underlying layers, an optical interference structure 30 may be formed from layer 32 and an underlying partially reflective metal layer 12 (which may have an oxide surface **12*s*). By varying the thickness of layer 32, varying optical effects can be obtained. Imaging of the construction removes layers 32, 12/12*s* and, if present, layer 34 to reveal substrate 10 (unless layer 34** is to accept ink, in which case it is formulated and applied to survive imaging pulses).

Figure 6:
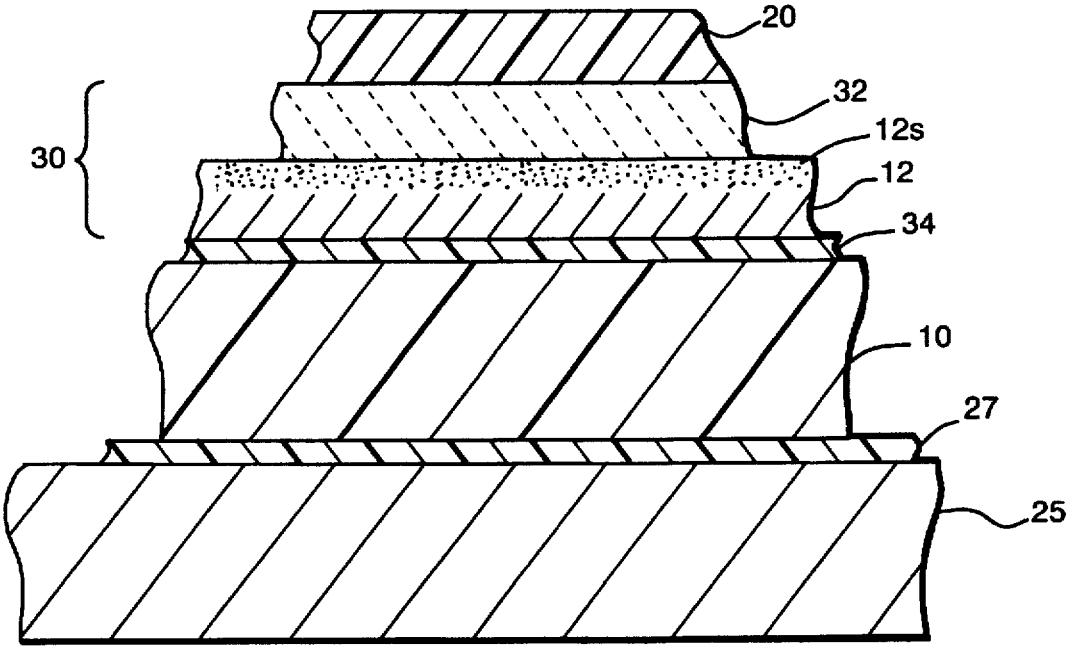
FIG. 6 is an enlarged sectional view of a lithographic printing plate having an optical interference structure comprising an inorganic metallic layer and an underlying layer of a surface-oxidized metal.

In the variation of this embodiment shown in FIG. 6, layer 32 is covered by a surface layer 20, and layers 10 and 20 exhibit opposite affinities for ink or an ink-adhesive fluid. Once again, surface layer 20 may be ink-repellent and substrate 10 oleophilic to produce a dry plate, or surface layer 20 may instead be hydrophilic and substrate 10 oleophilic and hydrophobic. Substrate 10 may also be laminated to a dimensionally stable support 25 by means of a laminating adhesive 27.

Figure 7:
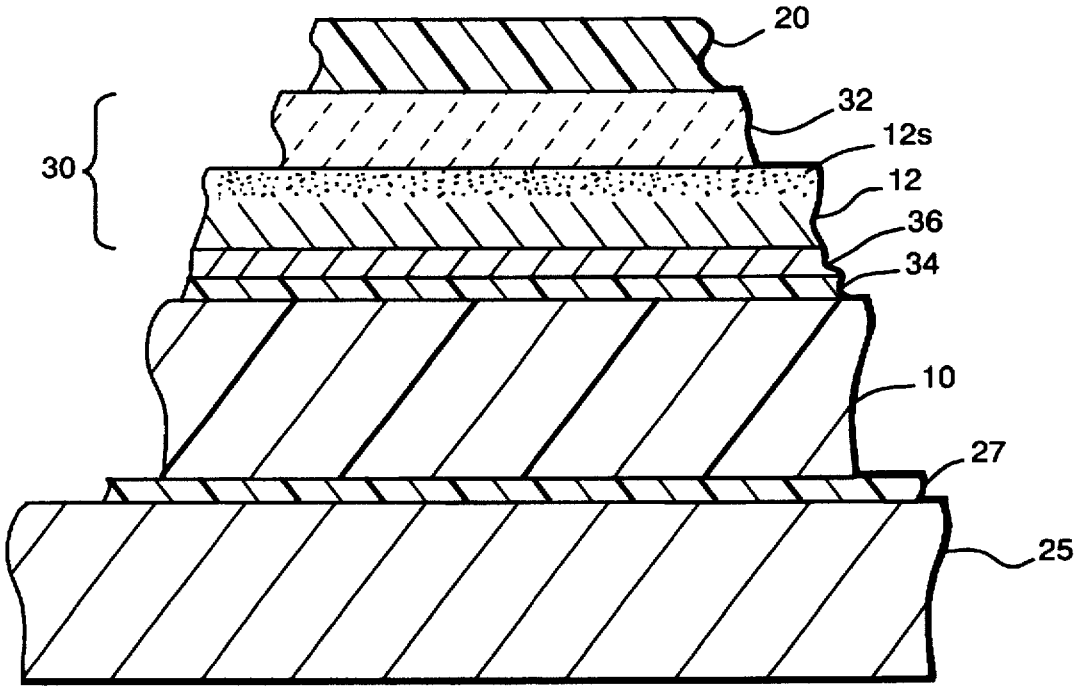
FIGS. 7 and 8 are variations of the construction shown in FIG. 6 and having, at different locations, a layer that reflects imaging radiation.
Figure 8:
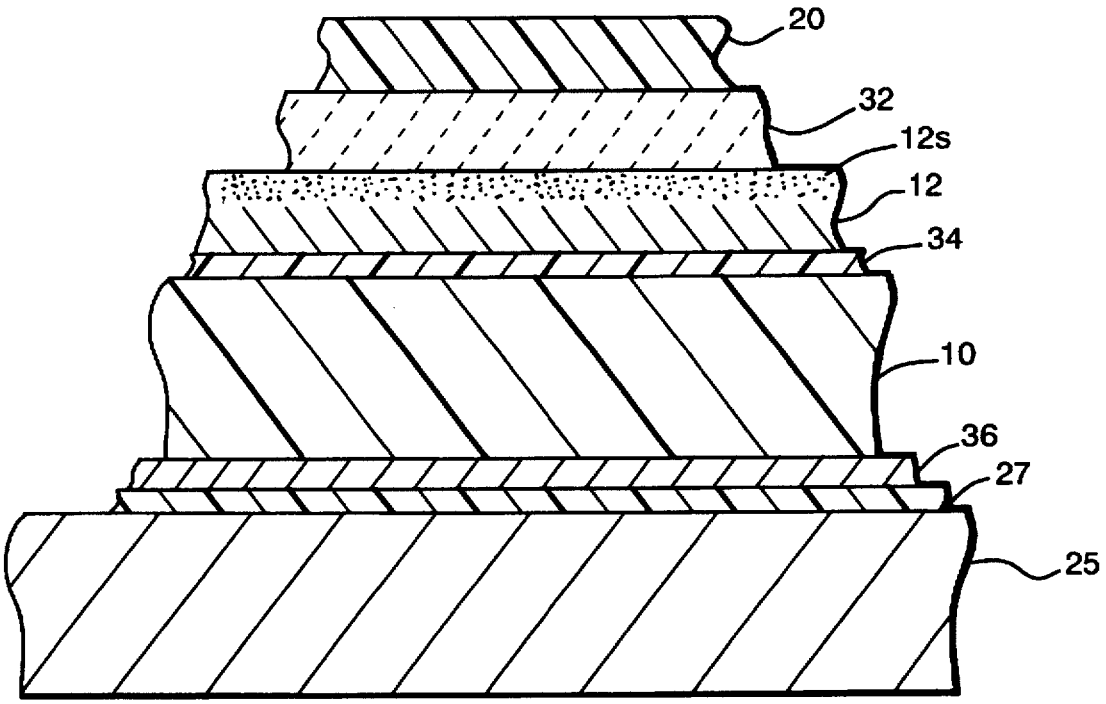

To provide for reflectivity, substrate 10 can be a white polyester film as discussed above. Alternatively, as shown in FIGS. 7 and 8, a reflective layer 36 can be disposed either beneath optical interference structure 30 or beneath substrate 10. The important aspects governing placement of the reflective layer are that (i) it should lie beneath the ablation layer(s) (here the optical interference structure), (ii) any intervening layers should be largely transparent to imaging radiation, and (iii) if the reflective layer is not intended to act as an ink-accepting surface, it should lie beneath (or constitute) the substrate.

The following examples illustrate practice of the invention.

Lithographic Printing Plates

EXAMPLE 1

A layer of titanium metal was vacuum sputtered with argon onto a plasma-treated, white polyester film (0.007 inch) to a thickness of about 300 Å and exposed to air, thereby permitting the formation of a passivating native oxide surface. When this sample was imaged on a Presstek PEARL platesetter (a computer-to-plate imagesetter utilizing diode lasers as discussed above) and used as a wet plate on a printing press, the observed plate life—that is, the number of impressions achieved before any noticeable print image degradation—was about 25,000 impressions.

EXAMPLE 2

Plates produced in accordance with Example 1 were overcoated by wiping, in separate procedures, with the FPC, TRUE BLUE, POLY PLATE, Varn TOTAL and Rosos fountain solution products discussed above, as well as aqueous gum arabic and various aqueous polyethylene glycols. The plates were then dried prior to imaging. It was found that the applied surface coatings improved plate-handling characteristics, such as resistance to scratching and fingerprinting, without degrading imaging sensitivity or press roll-up time.

EXAMPLE 3

In separate procedures, TiN layers of varying thickness—100 Å, 200 Å, 500 Å and 1000 Å—were coated onto plates produced in accordance with Example 1 by reactively sputtering titanium in an atmosphere of argon and nitrogen (ca. a 50/50 mixture) at about 4 μm pressure. The observed colors of the respective samples were light gold, dark gold, purple and deep blue; all incorporated hydrophilic surfaces. The 0.007 inch thick polyester plates were evaluated without modification; in a separate procedure, plates in accordance with Example 1 were prepared on 0.002 inch thick polyester and the resulting structure laminated to 0.006 inch thick aluminum sheets. When each of these samples was imaged on a Presstek PEARL platesetter and used as a wet plate to print on a press, the observed plate life depended strongly on the thickness of the titanium nitride layer (35,000, 75,000, 100,000 and over 250,000 impressions, respectively).

The foregoing procedures were repeated at sputtering pressures of 1 μm, 10 μm, 20 μm and 40 μm to form TiN-based plates having similar imaging and printing roll-up characteristics.

EXAMPLE 4

The procedure of Example 3 was repeated with the exception that an oxide layer was not permitted to form between the titanium and TiN layers. This was accomplished by sequentially sputtering both layers without venting (with air) between the coating processes. The imaging and press results were substantially identical to those of Example 3.

EXAMPLE 5

The procedure of Example 4 was repeated using a transparent polyester substrate; the resulting imaging and printing characteristics were similar to those of Example 3.

EXAMPLE 6

The procedure of Example 4 was repeated using, as a substrate, an aluminum plate (0.008 inch) that had been overcoated with a thermally stable white paint (HT-1300 white, supplied by Color Works, Solon, Ohio.) that served as an oleophilic thermal barrier coating following application and drying; the resulting imaging and printing characteristics were similar to those of Example 3.

EXAMPLE 7

Wet printing plates were prepared by reactively sputtering titanium with argon and nitrogen (50/50) at about 4 μm pressure onto white polyester substrates (0.007 inch) that had been treated by in-line plasma (argon/nitrogen), thereby forming hydrophilic TiN surface layers. Two plates having different thicknesses of TiN were prepared: ca. 500 Å (yellow-green) and ca. 2000 Å (deep blue-gray). The plates were similar, in terms of imaging and on-press printing, as the plates of Example 3.

EXAMPLE 8

Another wet printing plate was prepared by reactively sputtering titanium with argon and nitrogen (50/50) at about 4 mm pressure to a thickness of about 2 to 6 Å onto a plasma-treated (in an argon/nitrogen gas mix) white polyester substrate (0.007 inch), thereby forming an ablative sublayer. To this was applied, under the same conditions, a subsequent in-line deposition of 300 Å of titanium followed by another 300 Å of titanium nitride. Laser imaging sensitivity was improved in comparison with plates produced in accordance with Example 3.

EXAMPLE 9

A bronze-colored titanium boride wet plate was prepared by sputtering $TiB_2$ onto a plasma-treated white polyester substrate to a thickness of about 2000 Å. The resulting plate was imaged and successfully used for conventional wet printing.

EXAMPLE 10

A dry plate was prepared by overcoating the plate structure of Example 3 (TiN at 1000 Å) with the silicone formulation described in U.S. Pat. No. 5,487,338 (Examples 1–7); the silicone was applied by solvent to a dry coat weight of about 2 g/m$^2$ and then cured, after which the plate was imaged and used to print copy on a waterless press.

EXAMPLE 11

A wet plate was prepared by overcoating the plate structure of Example 3 (TiN at 1000 Å) with the polyvinyl alcohol formulation described in U.S. Pat. No. 5,487,338 (Example 17); the polyvinyl alcohol was applied by solvent to a dry coat weight of about 1.2 g/m$^2$ and then cured, after which the plate was imaged and used to print copy on a wet press.

EXAMPLE 12

A scratch-resistant wet plate was prepared by overcoating the plate structure of Example 3 (TiN at 1000 Å) with an aqueous solution containing 2% polyethylene glycol (molecular weight ca. 8000) and 0.5% hydroxypropyl cellulose. The mixture was applied using a #4 Meyer rod at an average coverage of 30 mg/m$^2$. After drying, the plate was imaged and mounted on a press, wiped with a wet WEBRIL Handi-pad and used to print copy.

Monochrome Proofs

EXAMPLE 13

A blue-on-silver monochromatic proofing material was prepared by reactively vacuum-sputtering, onto aluminized paper, titanium with argon/nitrogen ((50/50) at about 4 μm pressure) to a thickness of 2000 Å. This proofing paper was imaged on a Presstek PEARL platesetter to reveal a silver (aluminum) image area that contrasted with the blue TiN top coat.

EXAMPLE 14

A blue-on-white monochromatic proofing material was similarly prepared and imaged by sequentially vacuum-depositing thin layers of aluminum (ca. 100 Å), trimethylolpropane triacrylate polymer (ca. 0.25 μm) and titanium (ca. 300 Å) all onto a white polyester substrate. Gold-on-white and purple-on-white materials were likewise prepared by increasing the thickness of the acrylate spacer layer to about 0.5 μm and 0.75 μm, respectively.

It will therefore be seen that the foregoing approach can be used to produce a variety of graphic-arts constructions suitable for use as lithographic printing plates, photomasks and proofing sheets. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member directly imageable by laser discharge, the member comprising:

a. a hydrophilic, partially reflective first layer comprising a metal or metal compound;

b. a dielectric second layer beneath the first layer;

c. beneath the second layer, an at least partially reflective third layer comprising a metal or metal compound, the first, second and third layers forming an optical interference structure; and d. a substrate thereunder;

wherein e. the first layer is subject to ablative absorption of imaging radiation whereas the second layer is not; and f. the second layer is hydrophobic and oleophilic.

2. The member of claim 1 further comprising a hydrophilic finishing treatment over the first layer.

3. The member of claim 1 wherein the optical interference structure imparts a visible color to the printing member.

4. The member of claim 3 wherein the second layer has a thickness facilitating reinforced reflection of light of a predetermined wavelength, the thickness being equal to an even multiple of one-fourth the predetermined wavelength.

5. The member of claim 4 wherein the second layer has a thickness ranging from 0.05 to 0.9 μm.

6. The member of claim 1 wherein the second layer is a polyacrylate.

7. The member of claim 1 wherein the first and third layers are metal.

8. The member of claim 7 wherein the metal of the third layer is selected from the group consisting of aluminum, titanium, chromium, stainless steel, tin and zinc.

9. The member of claim 1 wherein the first layer is surface-oxidized titanium.

10. The member of claim 1 further comprising a metal support to which the substrate is laminated.

11. The member of claim 10 wherein the support comprises a material that reflects imaging radiation.

12. The member of claim 10 further comprising a layer of laminating adhesive anchoring the substrate to the support, the laminating adhesive comprising a material that reflects imaging radiation.

13. A lithographic printing member directly imageable by laser discharge, the member comprising:

a. a first layer consisting essentially of a compound of at least one metal with at least one non-metal, the at least one non-metal comprising at least one member of the group consisting of boron, carbon, nitrogen, and silicon; and b. a second layer adjacent thereto;

wherein c. the first layer is subject to ablative absorption of imaging radiation whereas the second layer is not; and d. the first and second layers exhibit different affinities for at least one printing liquid selected form the group consisting of ink and an adhesive fluid for ink.

14. The member of claim 13 further comprising a metal layer, also subject to ablative absorption of imaging radiation, between the first and second layers and directly overlying the second layer.

15. The member of claim 14 wherein the metal layer comprises at least one of (i) a d-block transition metal, (ii) aluminum, (iii) indium and (iv) tin.

16. The member of claim 15 wherein the metal layer is titanium.

17. The member of claim 13 wherein the first layer is hydrophilic.

18. The member of claim 13 wherein the first layer comprises at least one of (i) a d-block transition metal, (ii) an f-block lanthanide, (iii) aluminum, (iv) indium and (v) tin.

19. The member of claim 18 wherein the first layer comprises at least one of (i) titanium, (ii) zirconium, (iii) vanadium, (iv) niobium, (v) tantalum, (vi) molybdenum and (vii) tungsten.

20. The member of claim 18 wherein the first layer is TiN.

21. The member of claim 18 wherein the first layer is TiC.

22. The member of claim 18 wherein the first layer is TiCN.

23. The member of claim 18 wherein the first layer is TiON.

24. The member of claim 18 wherein the first layer is TiAlN.

25. The member of claim 18 wherein the first layer is TiAlCN.

26. The member of claim 13 wherein the first layer comprises a boride.

27. The member of claim 13 wherein the first layer comprises a carbide.

28. The member of claim 13 wherein the first layer comprises a nitride.

29. The member of claim 13 wherein the first layer comprises a carbonitride.

30. The member of claim 13 wherein the first layer comprises a silicide.

31. The member of claim 13 wherein the first layer exhibits a nodular texture that resists fracture.

32. The member of claim 13 further comprising a topmost oleophobic layer above the first layer, the second layer being oleophilic.

33. The member of claim 13 further comprising a topmost hydrophilic layer above the first layer, the second layer being hydrophobic and oleophilic.

34. The member of claim 13 further comprising a hydrophilic finishing treatment over the first layer.

35. The member of claim 13 wherein the second layer reflects imaging radiation.

36. The member of claim 13 further comprising a metal support to which the second layer is laminated.

37. The member of claim 36 wherein the support comprises a material that reflects imaging radiation.

38. The member of claim 36 further comprising a layer of laminating adhesive anchoring the second layer to the support, the laminating adhesive comprising a material that reflects imaging radiation.

39. The member of claim 13 further comprising a third layer, disposed between the first and second layers, to impart hardness.

40. The member of claim 13 further comprising a third layer, disposed between the first and second layers, the third layer comprising a material that partially reflects imaging radiation and is subject to ablative absorption of imaging radiation.

41. The member of claim 40 wherein the reflective layer is a polished metal.

42. The member of claim 41 wherein the metal is aluminum.

43. The member of claim 41 wherein the topmost layer is hydrophilic.

44. The member of claim 43 further comprising a fourth layer, disposed between the optical interference structure and the third layer, to impart hardness.

45. The member of claim 13 wherein the second layer is substantially transparent to imaging radiation and further comprising a third layer, disposed beneath the second layer, comprising a material that reflects imaging radiation.

46. The member of claim 13 wherein the first layer is partially reflective to visible radiation and further comprising:

a. a dielectric spacer layer disposed beneath the metal layer; and b. a layer at least partially reflective of visible radiation disposed beneath the dielectric spacer layer, the first, dielectric and reflective layers forming an optical interference structure imparting a visible color to the printing member.

47. A lithographic printing member directly imageable by laser discharge, the member comprising:

a. a topmost first layer which is polymeric;

b. an optical interference structure underlying the first layer; and c. a third layer underlying the optical interference structure;

wherein d. the optical interference structure is subject to ablative absorption of imaging radiation whereas the first layer is not; and e. the first and third layers exhibit different affinities for at least one printing liquid selected from the group consisting of ink and an adhesive fluid for ink.

48. The member of claim 47 wherein the optical interference structure imparts a visible color to the printing member.

49. The member of claim 47 wherein the optical interference structure comprises:

a. a first partially reflective layer;

b. a second dielectric spacer layer; and c. a third at least partially reflective layer beneath the dielectric layer.

50. The member of claim 49 wherein the spacer layer has a thickness facilitating reinforced reflection of light of a predetermined wavelength, the thickness being equal to an even multiple of one-fourth the predetermined wavelength.

51. The member of claim 50 wherein the spacer layer has a thickness ranging from 0.05 to 0.9 μm.

52. The member of claim 49 wherein the spacer layer is a polyacrylate.

53. The member of claim 49 wherein the third layer is metal.

54. The member of claim 53 wherein the third layer is titanium.

55. The member of claim 53 wherein the first layer is titanium.

56. The member of claim 53 wherein the first layer is a polyvinyl alcohol chemical species.

57. The member of claim 47 further comprising a metal support to which the third layer is laminated.

58. The member of claim 57 wherein the support comprises a material that reflects imaging radiation.

59. The member of claim 57 further comprising a layer of laminating adhesive anchoring the third layer to the support, the laminating adhesive comprising a material that reflects imaging radiation.

60. The member of claim 47 wherein the optical interference structure comprises:

a. a first interference layer comprising an at least partially transparent compound of at least one metal with at least one non-metal, the at least one non-metal being selected from the group consisting of boron, carbon, nitrogen, silicon and oxygen; and b. an at least partially reflective layer thereunder.

61. The member of claim 47 wherein the third layer is metal and further comprising a fourth layer, disposed above the third layer, comprising a thermally insulating material.

* * * * *